US005430426A

United States Patent [19]

Griebel

[11] Patent Number: 5,430,426

[45] Date of Patent: Jul. 4, 1995

[54] TRANSFORMER

[75] Inventor: Arthur H. Griebel, Troy, Mich.

[73] Assignee: Tocco, Inc., Boaz, Ala.

[21] Appl. No.: 120,482

[22] Filed: Sep. 13, 1993

[51] Int. Cl.[6] ..... H01F 27/28

[52] U.S. Cl. ..... 336/232; 336/62; 336/150; 336/183

[58] Field of Search ..... 336/62, 150, 192, 183, 336/192, 232

[56] References Cited

U.S. PATENT DOCUMENTS

| | | | |
|---|---|---|---|
| 3,300,614 | 1/1967 | Sorensen | 219/10.43 |
| 3,483,499 | 12/1969 | Lugten | 336/232 X |
| 3,503,026 | 3/1970 | Geisel et al. | 336/62 |
| 3,728,655 | 4/1973 | Reinke | 336/62 |
| 3,936,783 | 2/1976 | Wagemer | 336/62 |
| 4,584,551 | 4/1986 | Burgher | 336/62 X |
| 5,331,536 | 7/1994 | Lane | 336/126 |

*Primary Examiner*—Gerald P. Tolin
*Assistant Examiner*—L. Thomas
*Attorney, Agent, or Firm*—Vickers, Daniels & Young

[57] ABSTRACT

A pancake-type transformer particularly suited for connection to an inductor for inductively heating crankshafts is comprised of a single turn secondary defined by a plurality of generally U-shaped tubular conductors interleaved between the turns of a tubular, multiturn primary conductor having opposite ends connectable across a source of power. The conductors of the secondary have opposite ends each interconnected with a corresponding one of a pair of terminal blocks connected to a tubular inductor. The terminal blocks are outwardly adjacent the primary and secondary conductor portions at one end of the transformer and include corresponding current collectors which extend inwardly across the opposite sides of the conductor portions at the one end of the transformer. Coolant for flow through the secondary conductors is communicated with the opposite ends thereof through coolant passageways in the current collectors. Coolant for circulation through the tubular inductor is communicated with the latter through flow passageways in the terminals and one of the current collectors. A tap changing arrangement at the opposite end of the transformer comprises contact buttons on the primary conductor and a pivotal and linearly displaceable link mounted on one of a pair of busses by which the transformer is energized.

27 Claims, 4 Drawing Sheets

TRANSFORMER

BACKGROUND OF THE INVENTION

This invention relates to the art of transformers and, more particularly, to improvements in transformers for supplying energy to an inductor for inductively heating workpieces such as crankshafts.

Transformers particularly suited for use in connection with the inductive heating of workpieces such as crankshafts are well known and have an output side directly connected to the inductor for inductively heating a bearing surface of a crankshaft. Transformers of the foregoing character are shown, for example, in U.S. Pat. Nos. 3,300,614 to Sorensen; 3,503,026 to Geisel et al; 3,728,655 to Reinke and 3,936,783 to Wagemer, the disclosures of which are hereby incorporated herein by reference for background purposes. The output side of the secondary of such a transformer is directly connected to the inductor, such as through the use of terminal members, and the inductor is associated with the crankshaft in a manner whereby rotation of the crankshaft during induction heating is translated into oscillating movement of the transformer unit. The primary and secondary of the transformer as well as the inductor can be of tubular construction to facilitate the flow of coolant therethrough, and the primary and secondary are associated with a core of suitable ferromagnetic material. Connections are provided for communicating the primary and secondary as well as the inductor with a source of coolant. The coolant connections for the secondary, and often the inductor, are at the output end of the secondary where the secondary is connected to terminal blocks for connection with the inductor. The primary, at the opposite end of the transformer, is often provided with terminals providing taps to enable changing the primary to secondary ratio of the transformer. As is further known from such art, the primary and secondary can be interleaved, and the windings arranged for the transformer to have a flat-pancake profile. It is further known in the industry to provide for the secondary to comprise a plurality of individual loops interposed between adjacent convolutions of the primary and having opposite ends connected to a corresponding terminal member, such loops being tubular and connected with the terminal members to accommodate coolant flow through the secondary. In view of the nature of the use of the transformer in connection with inductively heating a crankshaft, and the disposition of the transformer relative to the crankshaft, it is of course desirable to provide for all the foregoing component parts thereof to have as thin a dimension as possible relative to a plane between the opposite ends of the transformer and transverse to the crankshaft axis.

In pancake-type transformers of the foregoing character heretofore provided, the terminal members by which the secondary is connected to the inductor and the portions of the primary and secondary at the end of the transformer at which the secondary is connected to the terminal members are exposed outwardly of the core which encloses the primary and secondary. The terminal blocks may, for example, be five to six inches long measured from the outermost portion of the primary and secondary and the point of connection between the terminal blocks and the inductor, and the terminal blocks together may measure about four inches wide in the plane of the transformer. This provides an area of considerable size and in which there is a considerable power loss during an induction heating operation. Another problem which primarily affects the economy of construction of such transformers is the plumbing configuration or configurations required to connect the transformer secondary and the inductor to a coolant source or sources. More particularly in this respect, either the coolant source connections have to be provided on laterally opposite sides of the transformer or, as shown in the Wagemer patent referred to above, provided on one side through the use of structurally complex conductor configurations. Yet another problem encountered with prior art pancake-type transformers is that the terminals providing taps for adjusting the primary to secondary ratio of the transformer have to be dimensionally accurate and of different contours, both of which add to the cost of the construction of the transformer. More importantly, in response to oscillation of the transformer during the induction heating of a rotating crankshaft the tap contacts are stressed by the flexible cables which are attached thereto and extend to a fixed location spaced from the transformer and at which tap changing is achieved. Such stressing of the tap contacts leads to fatigue thereof and/or the brazed connection thereof to the transformer winding, both of which result in undesirable down time for maintenance or replacement.

SUMMARY OF THE INVENTION

In accordance with the present invention, a pancake-type transformer is provided which advantageously minimizes or overcomes the foregoing and other problems encountered in connection with such transformers heretofore available. More particularly in this respect, conductor portions of the primary and secondary of the transformer at the end thereof adjacent the inductor have opposite sides, and the secondary has opposite ends at the latter end of the transformer each connected to a corresponding one of a pair of terminal blocks by which the transformer is connected to the inductor. The terminal blocks extend outwardly of the primary and secondary conductor portions at the one end of the transformer, and at least one current collector extends axially inwardly from one of the terminal blocks to overlie one of the opposite sides of the conductor portions at the one end of the transformer. The current collector collects current from the underlying conductor portions, thus to considerably reduce the power loss experienced without such a current collector. Preferably, each of the terminal blocks is provided with a current collector, and the two current collectors extend across opposite sides of the conductor portions at the one end of the transformer and, as further preferred, laterally of the corresponding terminal block and across the other terminal block, thus to optimize reduction of the power loss.

In accordance with another aspect of the invention, the current collector arrangement facilitates connecting the secondary of the transformer and the inductor connected to the terminal blocks to a source or sources of coolant from the same side of the transformer and in a manner which is structurally simple. In this respect, the source of coolant is connected in flow communication with the secondary and inductor through flow passageways provided in the current collectors and terminal blocks. This advantageously promotes economy with respect to construction of the transformer as well as the ease with respect to making the coolant connections.

In accordance with yet another aspect of the invention, a tap changing arrangement is provided at the opposite end of the transformer which overcomes the problems heretofore encountered in connection with the tap terminals being stressed by the flexible cables attached thereto in response to repeating oscillating displacement of the transformer. More particularly in this respect, the primary conductor portions at the opposite end of the transformer are, in accordance with the present invention, provided with a tap changing arrangement in which the major component parts, including a pair of rigid busses, are fixed relative to the transformer for movement therewith. The flexible cables are attached to the rigid busses which are supported such that neither the cables nor busses impose stress on the primary winding. Tap changing is achieved by providing the conductor portions of the primary with contacts in the form of buttons which are selectively engageable across the busses through a pivotal link displaceable with the transformer, whereby no stress is imposed on the tap changing components in response to displacement of the transformer during induction heating operations.

It is accordingly an outstanding object of the present invention to provide improvements in connection with a pancake-type transformer used in conjunction with the inductive heating of workpieces.

Another object is the provision of a transformer of the foregoing character wherein power losses through dissipation of power between conductor portions of the transformer and terminal blocks connecting the secondary to an inductor are significantly reduced.

A further object is the provision of a transformer of the foregoing character wherein terminal blocks connecting the secondary to the inductor are provided with one or more current collectors for reducing power loss.

Yet another object is the provision of a transformer of the foregoing character wherein the current collectors accommodate connection of the inductor and connection of the transformer secondary with a source or sources of coolant for circulation of the coolant through the inductor and transformer secondary.

Still another object is the provision of a transformer of the foregoing character having an improved tap changing arrangement associated with the transformer primary so as to enhance structural integrity with respect to the primary and tap changing components in conjunction with repeated oscillating displacement of the transformer during an induction heating operation.

Still a further object is the provision of a transformer of the foregoing character wherein the tap changing arrangement includes contacts and an adjustable tap changing link connected to the transformer for displacement therewith.

Yet another object is the provision of a transformer of the foregoing character which is more efficient in operation and less expensive to construct than similar transformers heretofore available while, at the same time, maintaining desirable minimum dimensions with respect to the length, width and thickness of the transformer.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Referring now in greater detail to the drawings wherein the showings are for the purpose of illustrating a preferred embodiment of the invention only and not for the purpose of limiting the invention, pancake-type transformer 10 comprises a multiturn primary defined by a primary conductor 12 and a single turn secondary defined by a plurality of secondary conductor portions 14 interleaved between the convolutions of the primary conductor.

Figure 1:
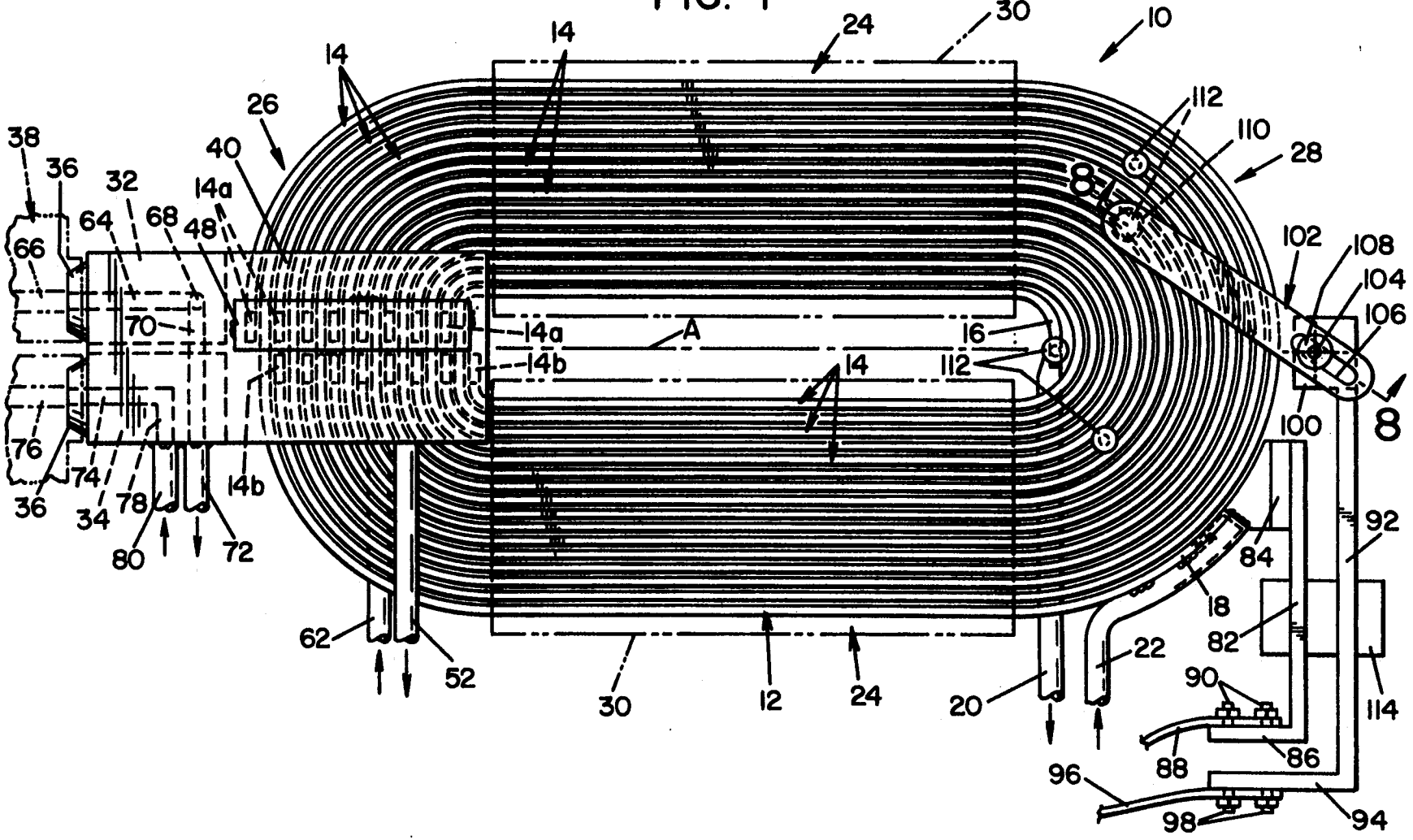
FIG. 1 is a plan view of a transformer in accordance with the present invention.
Figure 1A:
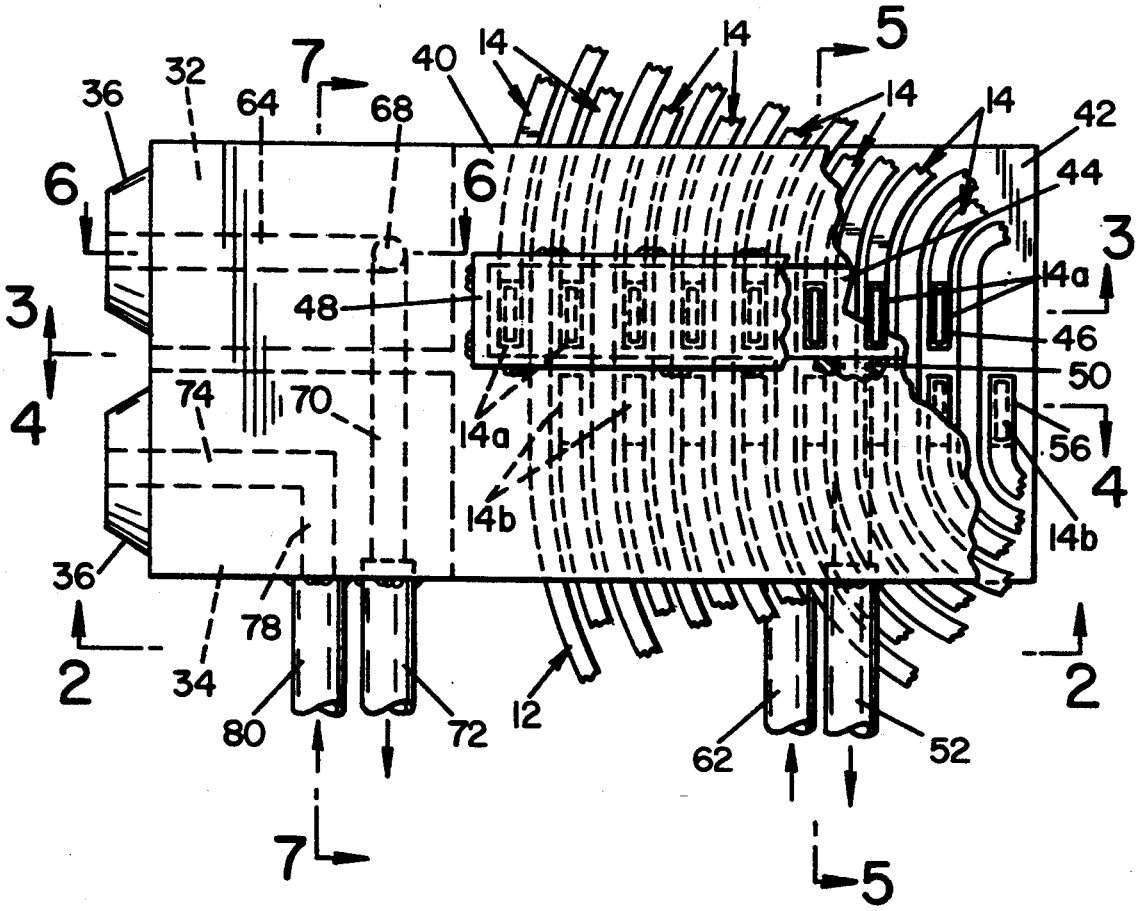
FIG. 1A is an enlarged plan view, partially in section, the output end of the transformer.
Figure 2:
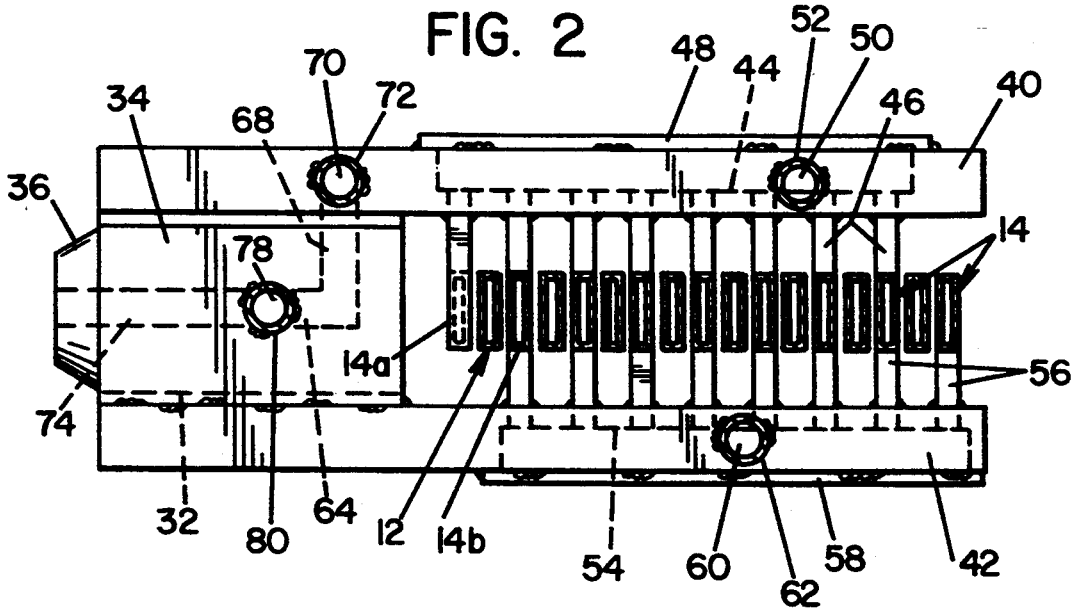
FIG. 2 is an elevation view, partially in section, of the output end of the transformer taken along line 2—2 in FIG. 1.

The primary and secondary conductors are copper tubing to facilitate the flow of coolant therethrough and are rectangular in cross-sectional configuration with the long dimension of the rectangle perpendicular to the plane of FIG. 1. Primary conductor 12 has opposite ends 16 and 18 respectively connected to a source of coolant, not shown, by tubular flow lines 20 and 22. The top and bottom sides of the primary and secondary conductors are respectively coplanar, and the interleaved conductors are in an elongated oval configuration providing linear intermediate portions 24 on laterally opposite sides of an axis A extending between the opposite ends of the transformer, an arcuate conductor portion 26 between the intermediate portions at one end thereof, and an arcuate conductor portion 28 between the intermediate portions at the opposite end thereof. Each of the intermediate portions 24 is enclosed in a corresponding ferrite core 30.

Each of the secondary conductors 14, in arcuate conductor portion 26, has closed opposite ends **14*a* and 14*b* respectively on laterally opposite sides of axis A. In the manner set forth more fully hereinafter, opposite ends 14*a* and 14*b* of the secondary conductors are conductively connected to first and second copper terminal blocks 32 and 34, respectively, and each of which terminal blocks is provided with a corresponding annular inductor contact 36 by which the transformer is electrically connected to an inductor 38. In accordance with the preferred embodiment of the invention, terminal blocks 32 and 34** are provided with current collector plates 40 and 42, respectively. Plates 40 and 42 are copper plates and, while shown as being secured to the corresponding terminal block such as by brazing, could be formed integrally therewith. Collector plate 40 is brazed to the top side of terminal block 32 and extends laterally therefrom across the top side of terminal block 34 in spaced apart relationship relative thereto and extends longitudinally inwardly from the terminal blocks across the top sides of the conductors in arcuate conductor portion 26. Plate 40 is spaced above the top sides of the conductors and extends inwardly thereacross to a location adjacent the corresponding ends of cores 30. Similarly, current collector plate 42 is brazed to the bottom side of terminal block 34 and extends laterally therefrom across the bottom side of terminal block 32 in spaced apart relationship relative thereto. Plate 42 extends longitudinally inwardly from the terminal blocks across the bottom sides of the conductors in arcuate conductor portion 26, in spaced apart relationship relative thereto, and to a location adjacent the corresponding ends of cores 30.

Figure 3:
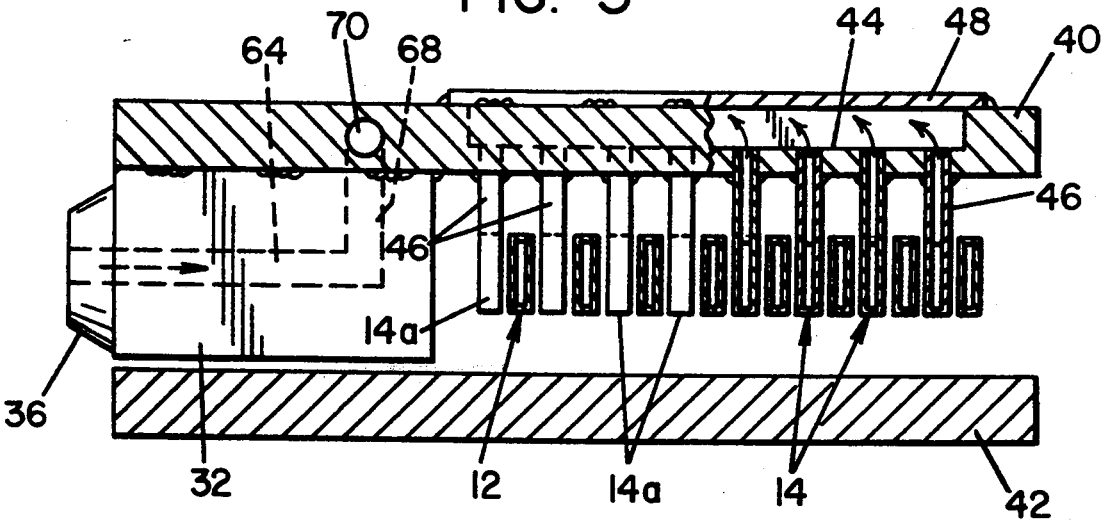
FIG. 3 is a sectional elevation view of a portion of the output end of the transformer taken along line 3—3 in FIG. 1A.
Figure 4:
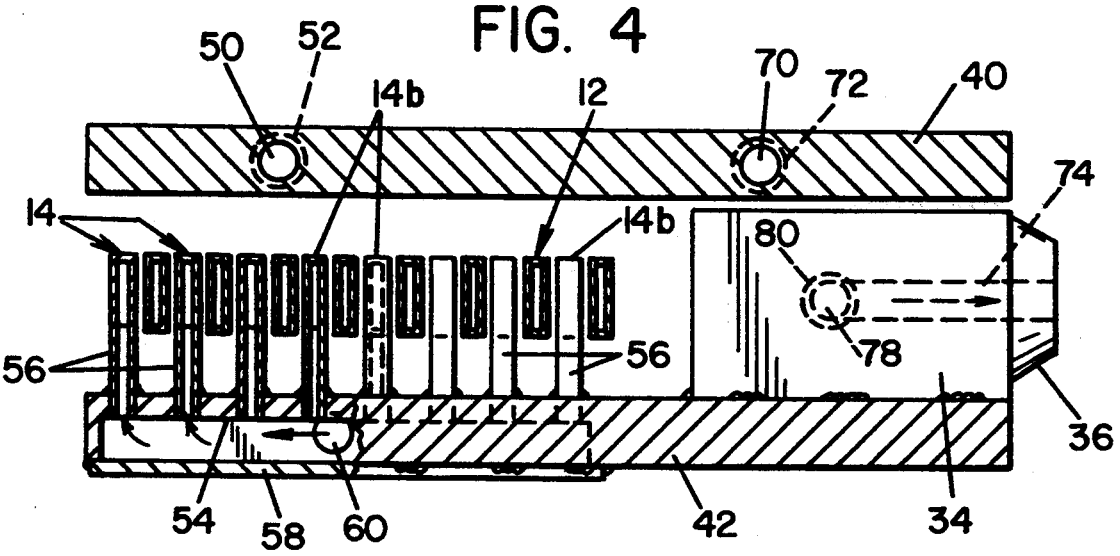
FIG. 4 is a sectional elevation view of a portion of the output end of the transformer taken along line 4—4 in FIG. 1A.
Figure 5:
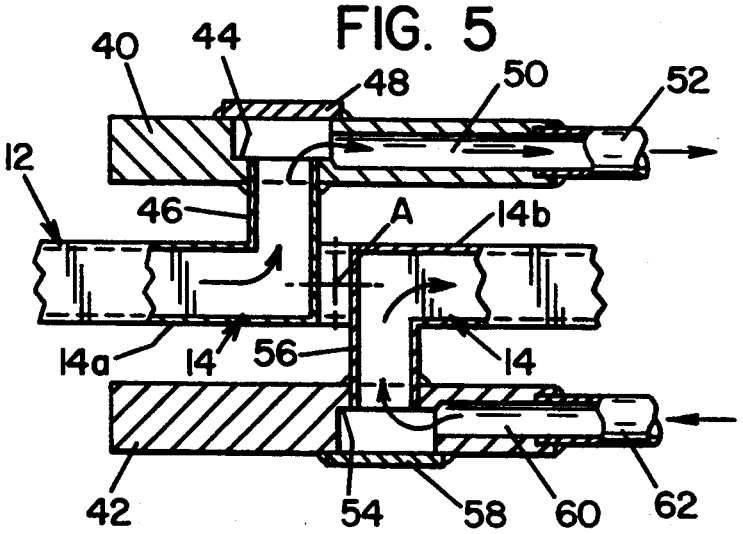
FIG. 5 is a sectional elevation view taken along line 5—5 in FIG. 1A and showing the connection of opposite ends of a conductor of the secondary connected to the current collectors.
Figure 6:
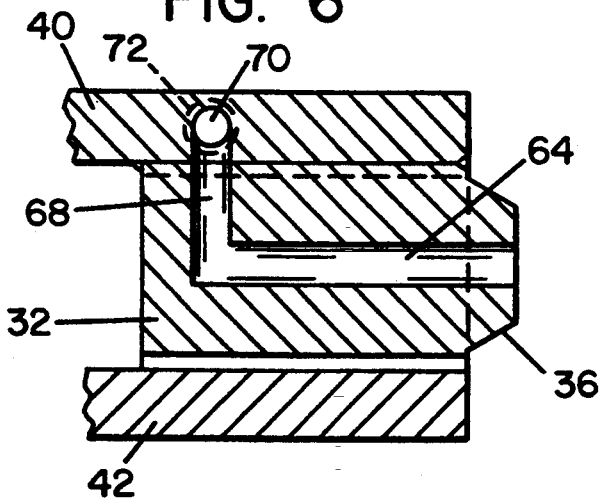
FIG. 6 is a sectional elevation view through one of the terminal blocks and the corresponding current collector taken along line 6—6 in FIG. 1A.
Figure 7:
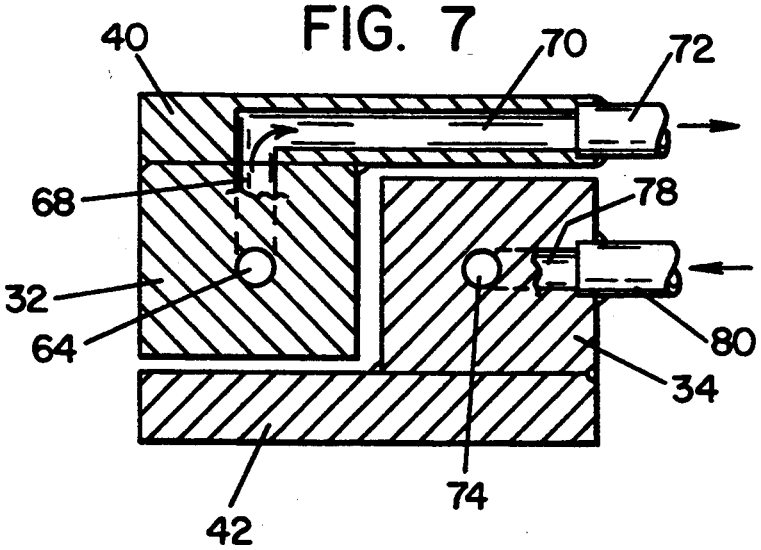
FIG. 7 is a sectional elevation view through the terminal blocks and current collector plates taken along line 7—7 in FIG. 1A; and, FIG. 8 is a sectional elevation view of the tap changing arrangement for the transformer taken along line 8—8 in FIG. 1.

As best seen in FIGS. 3–5, current collector plate 40 is provided with a longitudinally extending recess 44 in the outer side thereof and overlying ends 14*a* of secondary conductors 14. Ends 14*a* of conductor portions 14 are connected in communication with chamber 44 by corresponding connecting portions 46 which extend through openings therefor, not designated numerically, in the inner side of plate 40 and in which openings the connections are suitably secured such as by brazing. Recess 44 is covered by a plate 48 which is brazed to the outer side of plate 40, and a coolant flow passageway 50 extends laterally through collector plate 40 from the side thereof opposite recess 44 and is connected to a suitable conduit 52 connected to a source of coolant, not shown. Similarly, current collector plate 42 is provided with a longitudinally extending recess 54 in the outer side thereof overlying ends 14*b* of the secondary conductors, and the latter ends are connected in communication with recess 54 through connecting portions 56 which extend through openings therefor, not designated numerically, in the inner side of plate 42 and in which openings the connections are secured such as by brazing. Recess 54 is covered by a plate 58 secured to the outer side of plate 42 by brazing, and plate 42 is provided with a coolant passageway 60 opening laterally thereinto from the same side of plate 42 as passageway 50 and which is connected to a suitable conduit 62 connected to the coolant source.

As will be appreciated from the foregoing description of the connections between the opposite ends of the secondary conductors and current collecting plates 40 and 42, and assuming coolant passageway 60 in plate 42 to be the inlet for coolant, coolant from the source enters recess 54 from conduit 62 and passage 60 and flows therefrom through connections 56 to ends 14*b* of the secondary conductors and thence, with respect to FIG. 1, counterclockwise through secondary conductors 14 to ends 14*a* thereof. At the latter ends, the coolant flows into recess 44 through connection 46 and thence from the recess back to the source through coolant passageway 50 and conduit 52.

The terminal block and current collector plate structure described hereinabove also advantageously facilitates the circulation of coolant through the terminal blocks and inductor 38. More particularly in this respect, as best seen in FIGS. 1–4, 6 and 7 of the drawing, terminal block 32 is provided with an axially extending coolant passage 64 which is in communication with a coolant passageway 66 in inductor 38 through annular contact 36. The axially inner end of passage 64 communicates with an upwardly extending passage 68 which extends into current collector plate 40 and communicates therein with a passage 70 extending laterally through the plate from the same side thereof as coolant passages 50 and 60. The outer end of passage 70 is connected to a coolant conduit 72 connected to the coolant source. Terminal block 34 is provided with an axially extending passage 74 in communication with coolant passageway 76 in inductor 38 through the corresponding annular contact 36, and the axially inner end of passage 74 communicates with a laterally extending passage 78 which opens from the same side of terminal block 34 as the other coolant passages. The outer end of passage 78 is connected to the coolant source through a conduit 80. It will be appreciated of course, that coolant passageways 66 and 76 are in flow communication within inductor 38. Assuming passage 78 in terminal block 34 to be the inlet for coolant flow from the source, it will be appreciated that the coolant flows from the source through conduit 80 to passage 78 and then through passages 78 and 74 into and through inductor 38, and thence through passages 64, 68 and 70 in terminal block 32 and current collector plate 40 back to the coolant source through conduit 72.

Figure 8:
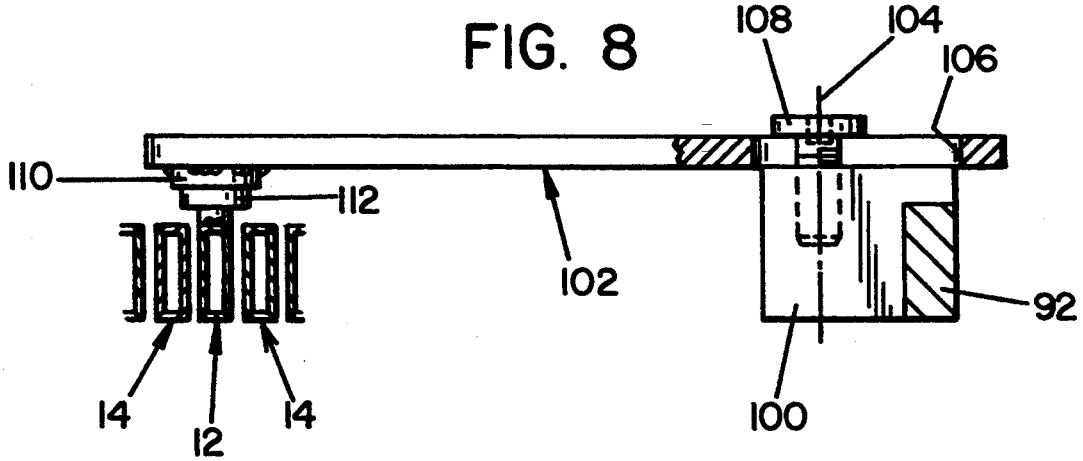

In accordance with another aspect of the invention, primary conductor 12 is adapted to be tapped at selective locations therealong which provide for selectively adjusting the primary to secondary ratio of the transformer. In the preferred embodiment, such selective tapping is achieved by an arrangement associated with the primary conductor 12 in the arcuate portions thereof in arcuate conductor portion 28. More particularly, as best seen in FIGS. 1 and 8 of the drawing, end 18 of primary conductor 12 is provided with a solid copper buss 82 secured thereto such as by a bracket 84 brazed to the buss and to end 18. Buss 82 has an axially extending leg 86 at the laterally outer end thereof and to which a flexible lead or cable 88 is secured by stud and nut arrangements 90. A second solid copper buss 92 extends generally parallel to buss 82 and has an axially extending laterally outer end 94 to which a flexible lead or cable 96 is secured by stud and nut arrangements 98. The laterally inner end 100 of bus 92 supports a copper link member 102 for pivotal and linear displacement relative to an axis 104 perpendicular to and intersecting axis A of the transformer. More particularly in this respect, link 102 is provided with an elongated slot 106 by which the link is adjustably mounted on inner end 100 of buss 92 by means of a threaded fastener 108 threadedly interengaged with an opening therefor in end 100 of the buss. Fastener 108 provides axis 104 and, when loosened, frees link 102 for rotation and/or linear displacement relative to the fastener. The underside of the opposite end of link 102 is provided with a contact 110 which, through such adjustment of link 102, is adapted to be selectively positioned above and in contact with any one of a plurality of terminal buttons 112 extending upwardly from and brazed to the top sides of selected ones of the arcuate portions of primary conductor 12. In this respect, it will be appreciated that terminal buttons 112 are at the proper locations on conductor 12 to provide desired primary to secondary ratios. A support component 114 of non-conducting material is suitably secured to buss 82 and supports buss 92 relative thereto, whereby it will be appreciated that the tap changing components are displaceable with the transformer during use thereof. Accordingly, only flexible leads 88 and 96 are flexed during use of the transformer, thus eliminating the imposition of undesirable stress on the tap changing components.

It will be appreciated from the foregoing description that coolant is circulated through the primary and secondary conductors of the transformer during operation thereof and through the inductor via the terminal blocks and that, upon connection of leads of 88 and 96 across a source of power, that the transformer secondary outputs a current through the terminal blocks to the inductor in accordance with the primary to secondary ratio to which the tap changing components are set. During operation of the transformer, the top current collecting plate 40 collects current from the top side of arcuate conductor portion 26 while bottom current collector plate 42 collects current from the bottom side thereof, thus substantially decreasing the power loss which would otherwise occur in the absence of current collector plates extending across the latter conductor portion.

While considerable emphasis has been placed herein on the specific structure and structural interrelationships between component parts of the preferred embodiment, it will be appreciated that many embodiments of the invention can be made and that many changes can be made in the preferred embodiment without departing from the principles of the invention. Accordingly, it is to be distinctly understood that the foregoing descriptive matter is to be interpreted merely as illustrative of the invention and not as a limitation.

Having thus described the invention it is claimed:

1. In a transformer having opposite ends and comprising primary conductor means and secondary conductor means, said primary and secondary conductor means having top and bottom sides and conductor portions at said opposite ends extending laterally of an axis between said opposite ends, core means surrounding said primary and secondary conductor means between said opposite ends, said secondary conductor means having end means at one of said opposite ends of said transformer, and terminal means for connecting said end means of said secondary conductor means to an inductor, the improvement comprising: said terminal means being axially outward of said conductor portions at said one end, and current collector means extending axially inwardly from said terminal means and overlying a plurality of said conductor portions at said one end.

2. A transformer according to claim 1, wherein said current collector means overlies both the top and bottom sides of said conductor portions at said one end.

3. A transformer according to claim 1, wherein said terminal means includes first and second terminal means laterally spaced apart relative to said axis and having top and bottom sides corresponding to said top and bottom sides of said conductor portions, and said current collector means includes first and second current collector means, said first current collector means extending laterally from said first terminal means across said top side of said second terminal means in spaced relationship thereto, and said second current collector means extending laterally from said second terminal means across said bottom side of said first terminal means in spaced relationship thereto.

4. A transformer according to claim 1, wherein said secondary conductor means is tubular for the flow of coolant therethrough, said end means of said secondary conductor means including first and second ends, means providing said current collector means with coolant inlet passageway means and coolant outlet passageway means, and means respectively connecting said first and second ends of said secondary conductor means with said coolant inlet passageway means and coolant outlet passageway means.

5. A transformer according to claim 1, wherein said terminal means includes first and second terminal means and said current collector means includes first and second current collector means respectively extending from said first and second terminal means, one of said first and second terminal means including first coolant passageway means for circulating coolant relative to said inductor, and the other of said first and second terminal means and the corresponding one of said first and second current collector means including second coolant passageway means for circulating coolant relative to said inductor.

6. A transformer according to claim 5, wherein said one of said first and second terminal means and said corresponding one of said first and second current collector means respectively have first and second outer sides spaced laterally in the same direction from said axis, said first and second coolant passageways respectively opening through said first and second outer sides.

7. In a transformer having opposite ends and comprising primary conductor means and secondary conductor means, said primary and secondary conductor means having top and bottom sides and conductor portions at said opposite ends extending laterally of an axis between said opposite ends, core means surrounding said primary and secondary conductor means between said opposite ends, said secondary conductor means having end means at one of said opposite ends of said transformer., and terminal means for connecting said end means of said secondary conductor means to an inductor, the improvement comprising: said terminal means being axially outward of said conductor portions at said one end, and current collector means extending axially inwardly from said terminal means and overlying at least one of the top and bottom sides of said conductor portions at said one end, said primary conductor means has first and second ends, first and second buss means for connecting said primary conductor means to a source of current, said first buss means being connected to one of said first and second ends of said primary conductor means, a plurality of contacts on said primary conductor portions at the other of said opposite ends of said transformer in locations providing desired primary to secondary ratios, and link means for selectively connecting said second buss means with any one of said contacts.

8. A transformer according to claim 7, wherein said contacts are on the top side of said primary conductor portions and said link means is pivotal about a pivot axis perpendicular to said top side.

9. A transformer according to claim 8, wherein said contacts are radially spaced different distances from said pivot axis, and said link means includes outer end means radially spaced from said pivot axis for engaging said contacts and means for adjusting the radial location of said outer end means relative to said pivot axis.

10. A transformer according to claim 1, wherein said primary and secondary conductor portions are interleaved and provide an elongate profile between said ends of said transformer and symmetric with respect to said axis, and wherein said top sides of said conductor portions are coplanar and said bottom sides of said conductor portions are coplanar.

11. A transformer having opposite ends and comprising interleaved primary and secondary conductor means including interleaved primary and secondary conductor portions at said opposite ends extending laterally of an axis between said opposite ends, said primary and secondary conductor means having top and bottom sides between said opposite ends, core means enclosing said primary and secondary conductor means between said conductor portions, said secondary conductor portions at one of said opposite ends of said transformer having first and second end means respectively on laterally opposite sides of said axis, first and second terminal means for connecting said secondary conductor means to an inductor, said first terminal means including a first terminal block spaced axially outwardly of said primary and secondary conductor portions at said one end, first current collector plate means extending axially inwardly from said first terminal block across the top sides of said primary and secondary conductor portions at said one end and first connecting means connecting said first end means of said secondary conductor portions with said first current collector plate means, said second terminal means including a second terminal block spaced axially outwardly of said primary and secondary conductor portions of said one end, second current collector plate means extending axially inwardly from said second terminal block across the bottom sides of said primary and secondary conductor portions at said one end, and second connecting means connecting said second end means of said secondary conductor portions with said second current collector plate means.

12. A transformer according to claim 11, wherein said first and second terminal blocks are on laterally opposite sides of said axis and have top and bottom sides, said first current collector plate means extends laterally from said first terminal block across said top side of said second terminal block, and said second current collector plate means extends laterally from said second terminal block across said bottom side of said first terminal block.

13. A transformer according to claim 11, wherein said secondary conductor means and said first and second connecting means are tubular for the circulation of coolant therethrough, and said first and second current collector plate means respectively include first and second passageway means for communicating said first and second connecting means and said secondary conductor means with a source of coolant.

14. A transformer according to claim 13, wherein said first and second terminal blocks are on laterally opposite sides of said axis and have top and bottom sides, said first current collector plate means extends laterally from said first terminal block across said top side of said second terminal block, and said second current collector plate means extends laterally from said second terminal block across said bottom side of said first terminal block.

15. A transformer according to claim 13, wherein said first and second current collector plate means have outer sides laterally spaced in one direction from said axis, said first and second passageway means respectively opening through said outer side of said first and second current collector plate means.

16. A transformer according to claim 13, wherein said first terminal block and first current collector plate means and said second terminal block respectively include third and fourth passageway means therethrough for communicating said inductor with a source of coolant.

17. A transformer according to claim 16, wherein said first and second terminal blocks are on laterally opposite sides of said axis and have top and bottom sides, said first current collector plate means extends laterally from said first terminal block across said top side of said second terminal block, and said second current collector plate means extends laterally from said second terminal block across said bottom side of said first terminal block.

18. A transformer according to claim 17, wherein said first and second current collector plate means and said second terminal block have outer sides laterally spaced in one direction from said axis, said first and second passageway means respectively opening through said outer side of said first and second current collector plate means, and said third and fourth passageway means respectively opening through said outer sides of said first current collector plate means and said second terminal block.

19. A transformer according to claim 18, wherein said primary conductor means is a multiturn coil having terminal ends at the other of said opposite ends of said transformer, and means at said other end of said transformer for selectively connecting portions of said coil between said terminal ends across a source of current to selectively vary the turns ratio of said transformer.

20. A transformer according to claim 19, wherein said means at said other end of said transformer includes first buss means connected to one of said terminal ends of said coil, a plurality of contacts on the top sides of said primary conductor portions at said other end, second buss means, a link member pivotally mounted on said second buss means for displacement about a pivot axis perpendicular to said top sides, said first and second buss means being connectable across said current source, said contacts being radially and angularly spaced relative to said pivot axis, and said link member being pivotal about said pivot axis to selectively connect any one of said contacts with said second buss means.

21. A transformer according to claim 20, wherein said link member has an outer end radially spaced from said pivot at said inner end and extending toward said outer end, said pivot axis extending through said slot.

22. A transformer according to claim 7, wherein said current collector means overlies both the top and bottom sides of said conductor portions at said one end.

23. A transformer according to claim 7, wherein said terminal means includes first and second terminal means laterally spaced apart relative to said axis and having top and bottom sides corresponding to said top and bottom sides of said conductor portions, and said current collector means includes first and second current collector means, said first current collector means extending laterally from said first terminal means across said top side of said second terminal means in spaced relationship thereto, and said second current collector means extending laterally from said second terminal means across said bottom side of said first terminal means in spaced relationship thereto.

24. A transformer according to claim 7, wherein said secondary conductor means is tubular for the flow of coolant therethrough, said end means of said secondary conductor means including first and second ends, means providing said current collector means with coolant inlet passageway means and coolant outlet passageway means, and means respectively connecting said first and second ends of said secondary conductor means with said coolant inlet passageway means and coolant outlet passageway means.

25. A transformer according to claim 7, wherein said terminal means includes first and second terminal means and said current collector means includes first and second current collector means respectively extending from said first and second terminal means, one of said first and second terminal means including first coolant passageway means for circulating coolant relative to said inductor, and the other of said first and second terminal means and the corresponding one of said first and second current collector means including second coolant passageway means for circulating coolant relative to said inductor.

26. A transformer according to claim 25, wherein said one of said first and second terminal means and said corresponding one of said first and second current collector means respectively have first and second outer sides spaced laterally in the same direction from said axis, said first and second coolant passageways respectively opening through said first and second outer sides.

27. A transformer according to claim 7, wherein said primary and secondary conductor portions are interleaved and provide an elongate profile between said ends of said transformer and symmetric with respect to said axis, and wherein said top sides of said conductor portions are coplanar and said bottom sides of said conductor portions are coplanar.

* * * * *